US007784228B2

(12) United States Patent
Gustafson

(10) Patent No.: US 7,784,228 B2
(45) Date of Patent: Aug. 31, 2010

(54) MIXED-USE PEDESTRIAN-ORIENTED PARKING STRUCTURE

(76) Inventor: Thomas F. Gustafson, 15725 Boeing Ct., Wellington, FL (US) 33414

( * ) Notice: Subject to any disclaimer, the term of this patent is extended or adjusted under 35 U.S.C. 154(b) by 624 days.

(21) Appl. No.: 10/538,829

(22) PCT Filed: Dec. 15, 2003

(86) PCT No.: PCT/US03/39804

§ 371 (c)(1),
(2), (4) Date: Apr. 28, 2006

(87) PCT Pub. No.: WO2004/055644

PCT Pub. Date: Jul. 1, 2004

(65) Prior Publication Data

US 2006/0272248 A1 Dec. 7, 2006

Related U.S. Application Data

(60) Provisional application No. 60/432,709, filed on Dec. 13, 2002.

(51) Int. Cl.
*E04H 6/10* (2006.01)
*E04H 14/00* (2006.01)
*E04H 1/06* (2006.01)

(52) U.S. Cl. ..... 52/176; 52/175; 52/236.3; 414/228

(58) Field of Classification Search ..... 52/174, 52/175, 176, 236.3; 414/227, 228
See application file for complete search history.

(56) References Cited

U.S. PATENT DOCUMENTS 1,432,132 A * 10/1922 Sturges ..... 52/175
1,637,110 A * 7/1927 Hornbostel et. al. ..... 52/175
1,725,991 A * 8/1929 Mcbride ..... 52/175
1,809,140 A * 6/1931 Gordon ..... 52/176
1,830,518 A * 11/1931 Mason ..... 52/176
2,565,243 A * 8/1951 Lodewyk ..... 52/176
2,631,743 A * 3/1953 Hornick ..... 414/228
2,674,014 A * 4/1954 Clements ..... 52/175
2,825,938 A * 3/1958 Ferreira ..... 52/175
2,908,946 A * 10/1959 Sullivan ..... 52/175
2,960,732 A * 11/1960 Khoury ..... 52/175
3,105,999 A * 10/1963 Wilhelm ..... 52/176
3,562,984 A * 2/1971 Merle et al ..... 52/175
3,739,540 A * 6/1973 Ennis, Jr. ..... 52/175
3,824,752 A * 7/1974 Weston ..... 52/176
4,555,877 A * 12/1985 Libra ..... 52/79.4
4,884,662 A * 12/1989 Cho et al. ..... 186/36

(Continued)

FOREIGN PATENT DOCUMENTS

JP 2-27065 * 1/1990

*Primary Examiner*—Robert J Canfield
(74) *Attorney, Agent, or Firm*—Melvin K. Silverman; Yi Li

(57) ABSTRACT

A mixed-use pedestrian-oriented parking structure, includes at least two sequential multi-level parking units; a series of one-directional parking access aisles; angled parking around a central atrium and parallel parking at the outer edge of the parking decks; a liner building surrounding the parking units on at least one side of each parking unit; and a multi-use buffer corridor defining an interface between the parking units and the liner building which includes at least one common wall with the buffer corridor, the wall including passages for access to and from the buffer corridor.

15 Claims, 7 Drawing Sheets

U.S. PATENT DOCUMENTS 4,901,482 A * 2/1990 Lockard et al. ..... 52/33
4,971,505 A * 11/1990 Sawyer ..... 414/232
5,234,305 A * 8/1993 Hotta et al. ..... 414/228
5,749,186 A * 5/1998 Kaufman et al. ..... 52/236.3
6,209,270 B1 * 4/2001 Johnston ..... 52/175
6,405,496 B1 * 6/2002 Stewart et al. ..... 52/185
6,550,197 B1 * 4/2003 Gray ..... 52/236.3
6,561,727 B1 * 5/2003 Gustafson, Jr. ..... 404/1
D486,237 S * 2/2004 Henry ..... D25/1
2002/0073637 A1 * 6/2002 Stewart et al. ..... 52/236.3
2004/0006940 A1 * 1/2004 Gray ..... 52/236.3
2005/0235587 A1 * 10/2005 Blumberg et al. ..... 52/236.3
2006/0228196 A1 * 10/2006 Li ..... 414/227
2008/0038054 A1 * 2/2008 Gustafson et al. ..... 404/1

* cited by examiner

MIXED-USE PEDESTRIAN-ORIENTED PARKING STRUCTURE

REFERENCE TO RELATED APPLICATION

This application claims the priority under 35 U.S.C. 119(e) of Application Ser. No. 60/432,709, filed Dec. 13, 2002 and the same is incorporated herewith in its entirety.

BACKGROUND OF THE INVENTION

The present invention relates to an inventive parking structure, the purpose of which is to promote pedestrian activity in, and ease of access to retail, commercial office, residential, transit and other facilities within a liner building about each wall of the parking structure and outward of the mixed-use pedestrian-oriented parking structure.

Historically, little variety has existed in the design and structure of multi-story parking facilities as, for example, is reflected in U.S. Pat. No. 5,234,305 (1993) to Hotta et al, entitled Multi-Story Parking Facility; U.S. Pat. No. 5,749,186 (1998) to Kauman et al, entitled Multi-Story Building Complex With Access Between Garage, Building Decks And Each Floor At Same Elevation; and U.S. Pat. No. 6,209,270 (2001) to Johnston, entitled Multi-Level Building With Ramp. In all cases, such designs park cars perpendicular to and on both sides of two-directional automotive parking access isles that run throughout the parking garage structure. Therein, a multi-story building to which a given multi-level garage relates does not define any particular complemental relationship thereto. In other words, the prior art in the instant area has addressed three primary concerns, i.e., that of the entrance and exit of the largest number of vehicles possible in a given period of time, secondly, the parking of the largest number of vehicles per square foot of parking structure and, finally, schemes for access, typically from a single side of the garage structure to a multi-story building associated therewith.

The within invention addresses the above issues but, more importantly, provides for a more ergonomic relationship between the mix-use pedestrian-oriented parking structure, the multi-story, mixed-use liner building with which it is associated, and destinations outward of the mix-use pedestrian-oriented parking structure so as to provide better pedestrian access between the parking structure and the destinations of interest to the individual travelers who use the parking structure.

SUMMARY OF THE INVENTION

The inventive mixed-use pedestrian-oriented parking structure comprises at least two parking parts or halves, each 90 to 115 feet in width and approximately 200 feet in length. A liner building that is a mixed-use structure, generally of 20 to 90 feet in depth, surrounds the two or more parts of the parking structure on one or more sides to provide conditions that induce large-scale walking behavior. Colors, smells, sounds, shapes, designs and tastes that attract and motivate people to walk forward in spaces that are interesting, useful, safe and comfortable are positioned at a ground level along streets or mixed-mode pedestrian-oriented corridors or on multi-level pedestrian corridors between or along the parts and elsewhere along the perimeter of other structures and coordinated with surrounding structures and needs of pedestrian movement to provide protection from the rain, sun, heat, cold, wind or snow. In a typical application, a pedestrian or mixed-mode corridor will be provided between the parts of the mixed-use liner building structure. In addition, a pedestrian corridor of retail and other uses will bisect the major axis of the garage, between parts or halves, to provide an interior pedestrian corridor (a zaquan) that leads to a center courtyard and, thereafter, through a second half of the parking structure to the far side of the present mixed-use pedestrian-oriented parking complex.

It is accordingly an object of the invention to provide a multi-story building and parking structure having direct geometric and ergonomic relationship between vehicle and pedestrian entrances and exits of a parking structure and floors of like elevation of a surrounding liner building.

It is another object to provide a liner building as part of the mixed-use, pedestrian-oriented parking structure to permit residential and business occupants of the building to minimize distances between parked cars and destinations within the building.

It is a further object of the invention to provide said mixed-use pedestrian-oriented parking structure of the above type to maximize use of natural light therein and increase visibility between parking areas and the destination building.

It is a still further object to provide a parking structure of the above type sufficient to enable cars and delivery vehicles to enter the mixed-use pedestrian-oriented parking complex without intersection with a vehicular exit.

It is a still further object to provide within this parking structure, adequate turning radius, angled parking and parallel parking including crossing opportunities to adjoining parking structures.

It is a still further object to provide for reduced vehicular conflict with pedestrian flux, throughout the mixed-use, pedestrian-oriented parking structure and at the entries and exits of the mixed-use, pedestrian-oriented parking structure, both upwardly, downwardly and outwardly of the structure.

It is another object of the invention to enable usage of trees and other foliage materials to grow in the center of the mixed-use, pedestrian-oriented parking structure as well is at the interface of the parking element and the liner building and along the perimeter of the liner building.

It is a yet further object to provide a complex of the above type that allows residential and business occupants of the liner building to easily clean or wash adjacent the parking areas within the parking structure.

It is a still further object of the invention to enable an enhanced walking environment through all areas of a liner building and parking structure, inclusive of a major axis thereof, the minor axis thereof, and a perimeter thereof.

It is another object of to enable usage trees and other foliage material to grow in the center of the mixed-use, pedestrian-oriented parking structure as well is at the interface of the parking element and the liner building and along the perimeter of the liner building It is another object of the invention to provide a sound barrier between the pedestrian-oriented areas within or to one side of the mixed use, pedestrian-oriented parking and liner building complex and the traffic, industrial, airport or other noise generators that can adversely affect a pedestrian-oriented community, or other outside environments.

The above and yet other objects and advantages of the present invention will become apparent from the hereinafter set forth Brief Description of the Drawings and Detailed Description of the Invention.

DETAILED DESCRIPTION OF THE INVENTION

Figure 1:
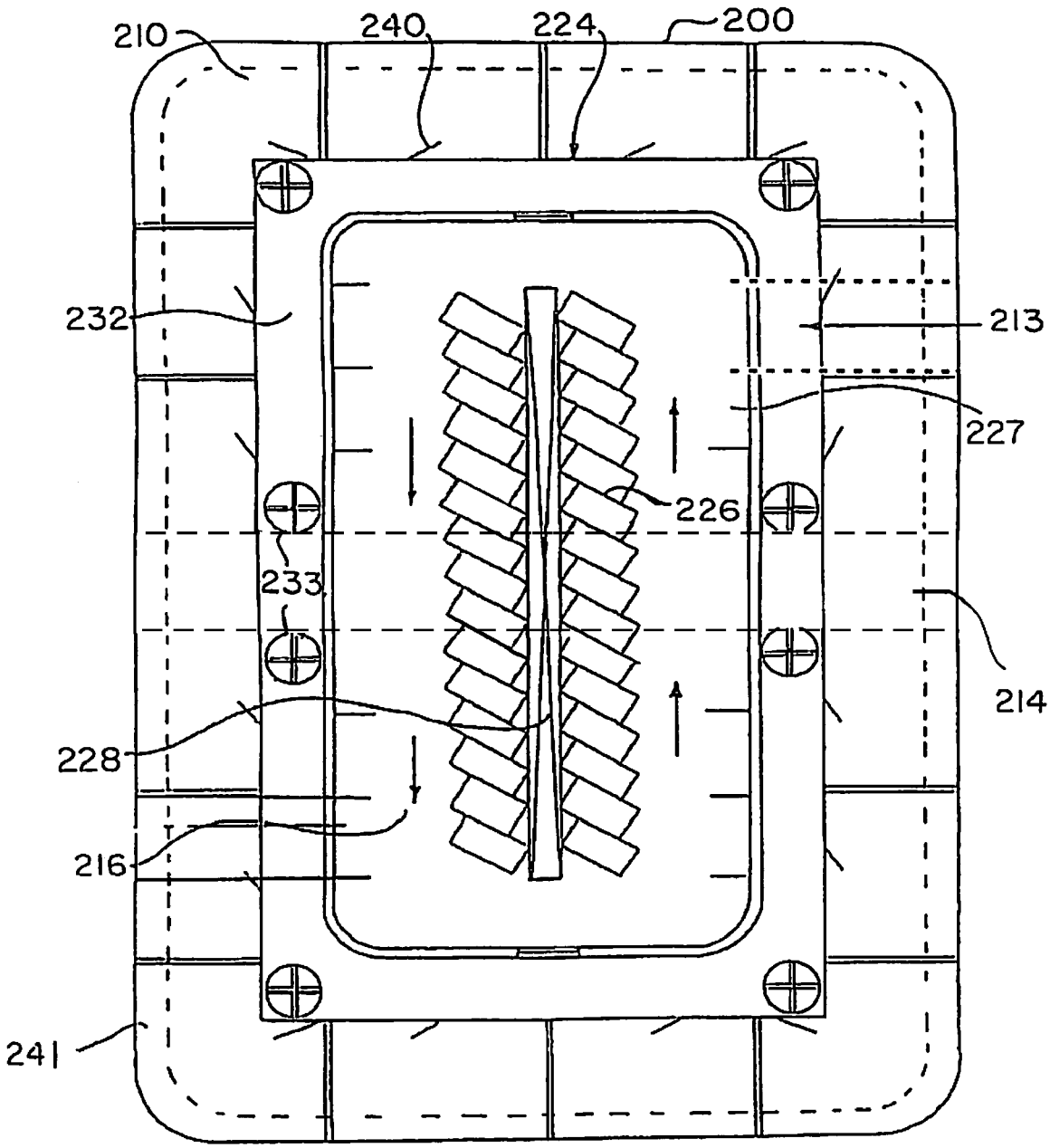
FIG. 1 is a horizontal top view of a representative deck of the mixed-use, pedestrian-oriented parking structure and is a view taken along Line 1-1 of FIG. 3.

A multi-level parking garage of the mixed-use, pedestrian-oriented structure comprises multiple parts. More particularly, a first part, or entry garage, 200 (see FIGS. 1 thru 4 of the structure) is used to enter the complex at entrance 213 and to the one-directional upward ramp 222 to second, third or higher floors thereof. A second part, or exit garage, 202 of the structure is used to exit through one-directional downward ramp 219 and to depart the parking structure 216 at exit area 217. A vehicular cross-over 204, between portions 200 and 202, connects the complex, allowing for cars and delivery trucks 203 to move from the entry and upward ramp 222 portion of said part 200, to the downward ramp 219 and exit area 217 of such structure 202. The vehicular cross-over 204, typically at the third floor (see FIG. 3), allows for a second floor mixed-use cross-over 208 to link said portions 200 and 202 and their respective liner buildings 210 and 212 into an overhead structure that protects pedestrians 205 from the sun, snow, heat, cold, wind and rain as they walk from one part to the other of the inventive mixed-use pedestrian-oriented parking structure at either a first level street crossing or mixed-mode corridor 206, or at said second level mixed-used cross-over 208.

Figure 2:
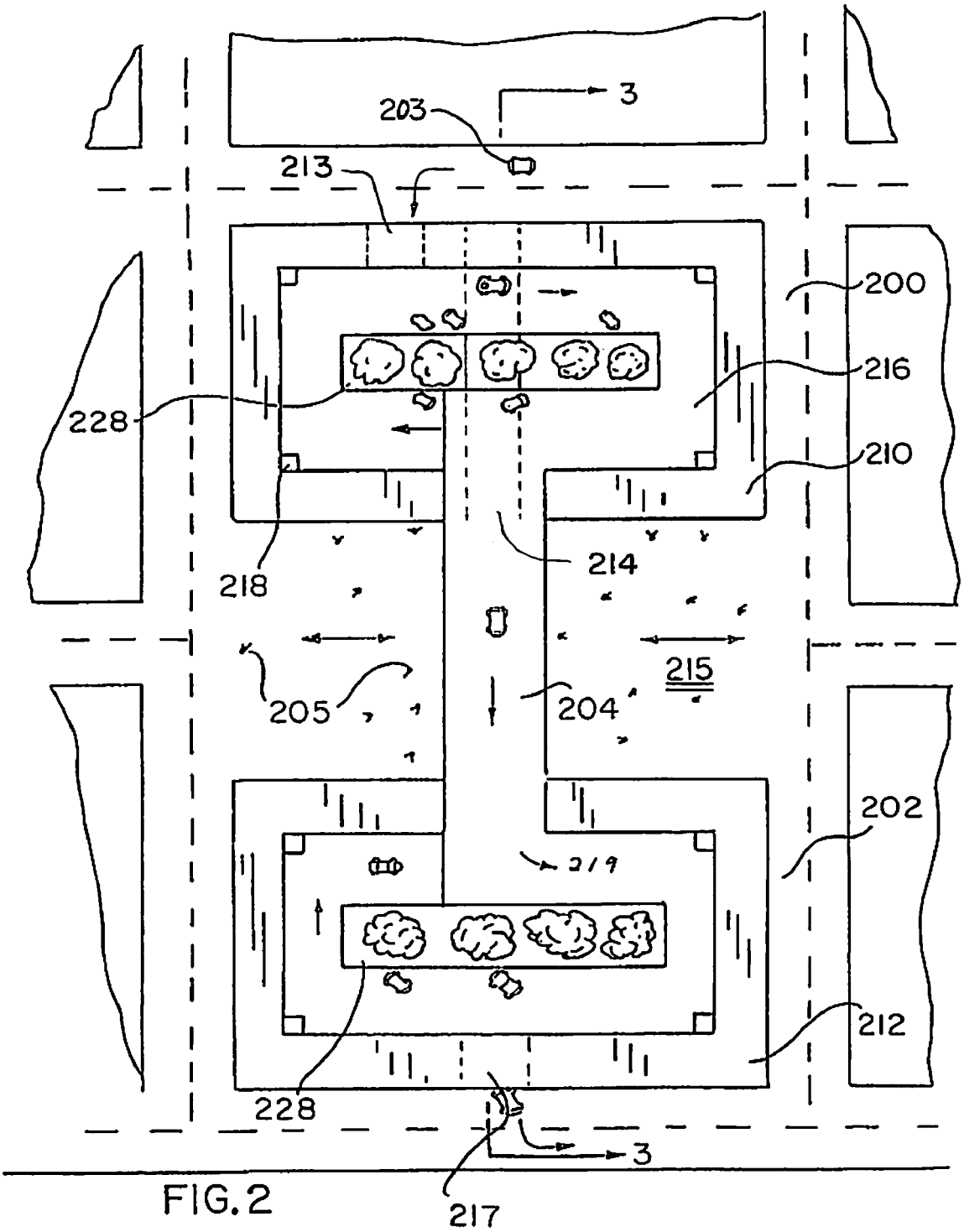
FIG. 2 is a horizontal schematic view showing the use of multiple parking garage-liner building structures of the type shown in FIG. 1 about a common pedestrian ground space and is a view taken along Line 2-2 of FIG. 3.
Figure 3:
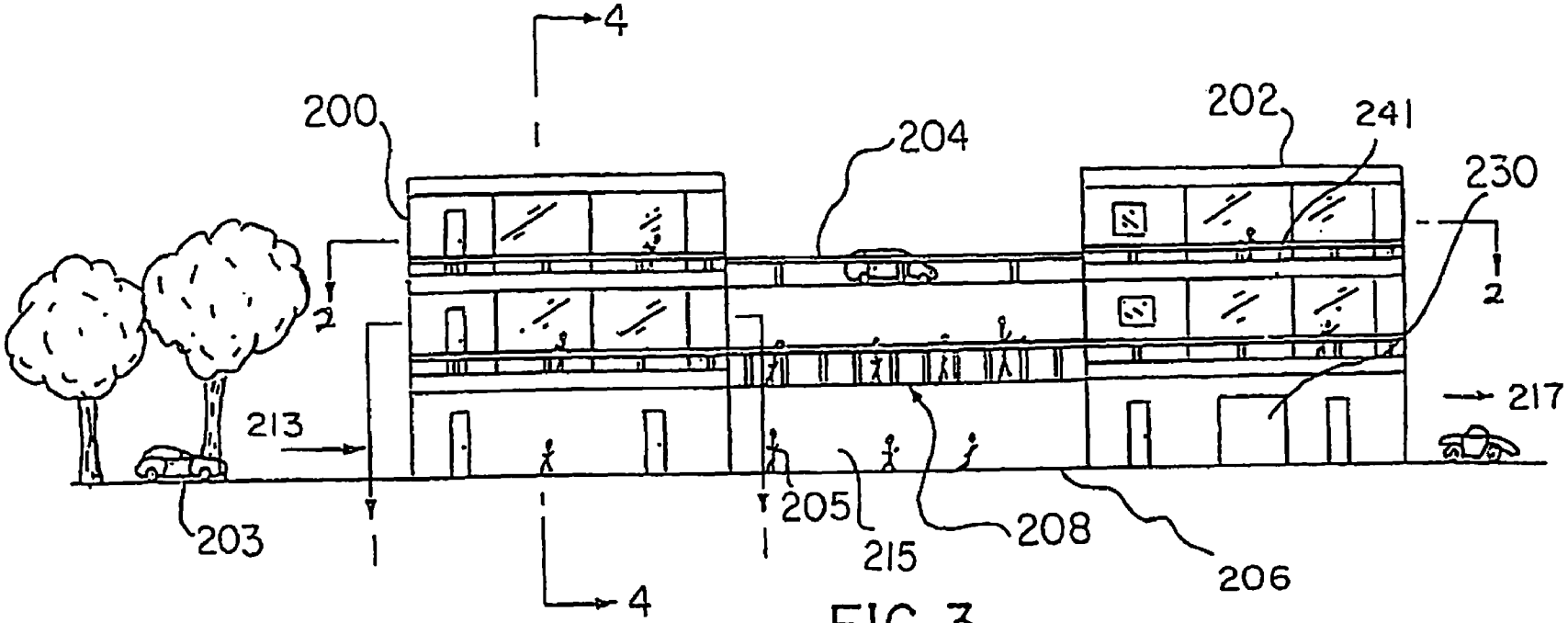
FIG. 3 is a vertical longitudinal cross-sectional view taken along Line 3-3 of FIG. 2.

As may be noted with reference to FIGS. 1-3, parking garage portion 216 within liner building 210 provides for parallel parking 227 at the perimeter thereof, this interrupted as necessary by pedestrian corridors, bridges and entrance platforms 242 (see FIG. 5) to provide a place for residents, guests, business employees, and their clients and delivery services to access back doors 240 (see FIG. 5) located at a perimeter 224 which comprises an interface between parking garage 216 and the liner building 210. Further, angled parking 226 surrounds an opening or atrium 228 at the center of garage 216 of first portion 200 of said structure. As may be noted in the embodiment of FIG. 1, direction of travel within the garage is one way (see arrows) and allows for sufficient width (up to 18 feet wide) and heights (in a range of 14 to 18 feet high) for automobiles and delivery trucks. Incorporated into the structure may be a central service or loading dock facilities provided at a ground floor 230 (see FIG. 3). With further reference to FIG. 1, there is shown, outwardly of the first liner building 210, and second liner building 212, arcades and awnings, balconies, and roof overhangs 241 which peripherally surround said liner buildings 210.

Further shown in FIG. 1 is a buffer corridor 232 into which HVAC 233 and other environmental facilities may be placed. As shown in FIG. 2, pedestrian ground space 215 is a preferably ground level pedestrian-oriented corridor situated between parts 200 and 202 of the multi-level garage.

Figure 4:
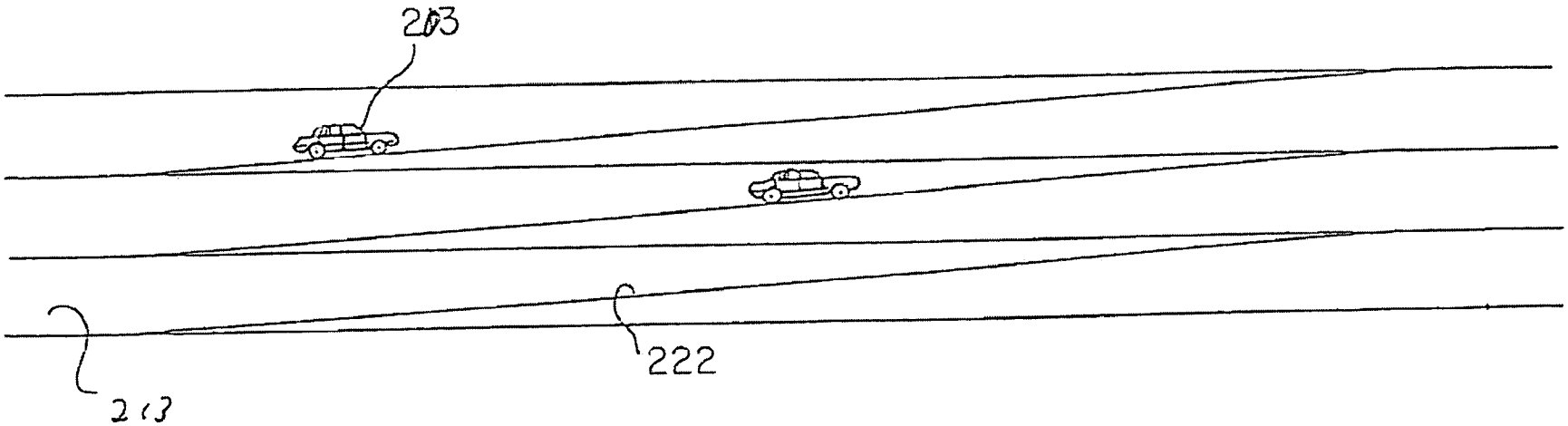
FIG. 4 is a vertical cross-sectional view taken along Line 4-4 of FIG. 3.

Shown at FIG. 2 is the relationship between an entry 213 of the embodiment of FIG. 1 and an exit 217, this inclusive of said vehicular cross-over 204 which connects the respective upward portions and downward portions of the garage. The system thereof is shown in vertical axial cross-sectional view in FIG. 3. The ramp structure of the system is shown in FIG. 4, which is a vertical cross-sectional view taken through Line 4-4 of FIG. 3.

The resultant parking structure promotes pedestrian activity by providing a rear or back door access to an adjoining liner building and further provides interior pedestrian access corridors 214, arcades 241, covered street crossing or mixed mode corridors 206, and mixed-use crossovers 208 to provide pedestrian access between and through the components of the mixed-use, pedestrian-oriented parking structure.

The mixed-use pedestrian-oriented parking structure is designed to absorb traffic by efficiently converting automotive trips into pedestrian movements that eliminate traffic congestion and improve intermodel pedestrian access to transit and other transportation modes and to frame public squares and pedestrian or mixed-mode corridors and streets with horizontal components, as discussed in the Ergonomic Hybrid Transit Access Corridor of my U.S. Pat. No. 6,561,727. Within these public spaces (squares and corridors), small transit, parking shuttle and local circulating vehicles help to more efficiently link parking facilities to destinations within a one to four square mile area and with the mixed-use, pedestrian-oriented parking structure, collectively, constitute a pedestrian-oriented design and transit access system that will improve intermodel movements within the urban community.

The above defines a better method to park automobiles within the shroud of a 20 foot to 90 foot liner building and to incorporate elements of interior design to produce a mixed-use, pedestrian-oriented parking structure that positions parking spaces to better provide access, air, light and security to customers, visitors and residents of mixed-use liner buildings.

The present invention also provides for said parallel parking 227 along the outer edge of the parking deck 216, said angled parking 226 at the center, said central air/light well or atrium 228 along a center axis of a generally rectangle-shaped, very narrow, garage facility and, optionally, said air/light well or atrium 228 between the parking and liner building components of the mixed-use pedestrian-oriented parking structure. A one-directional driving corridor or parking access isle (see arrows of FIG. 1) thereby provides an opportunity to build a matched pair or more of garages with a third floor vehicular cross-over 204 to structurally integrate with a second floor mixed-use crossover 208 for retail, restaurant or mixed-use activities and to provide cover for mid-block, at ground pedestrian crossings and mixed-mode corridors 215. The narrow width of the garage (approximately 90-115 feet) allows for structural columns 218 to be moved to the perimeter of the parking structure or within said air/light well or atrium 228 to thereby avoid shadowing within the parking garage and improve user safety. The narrow characteristic of such garage also makes for an easier application of use of the liner building, given the space needs of retail, office and other commercial or residential uses and the typical dimensions of a city block.

Figure 5:
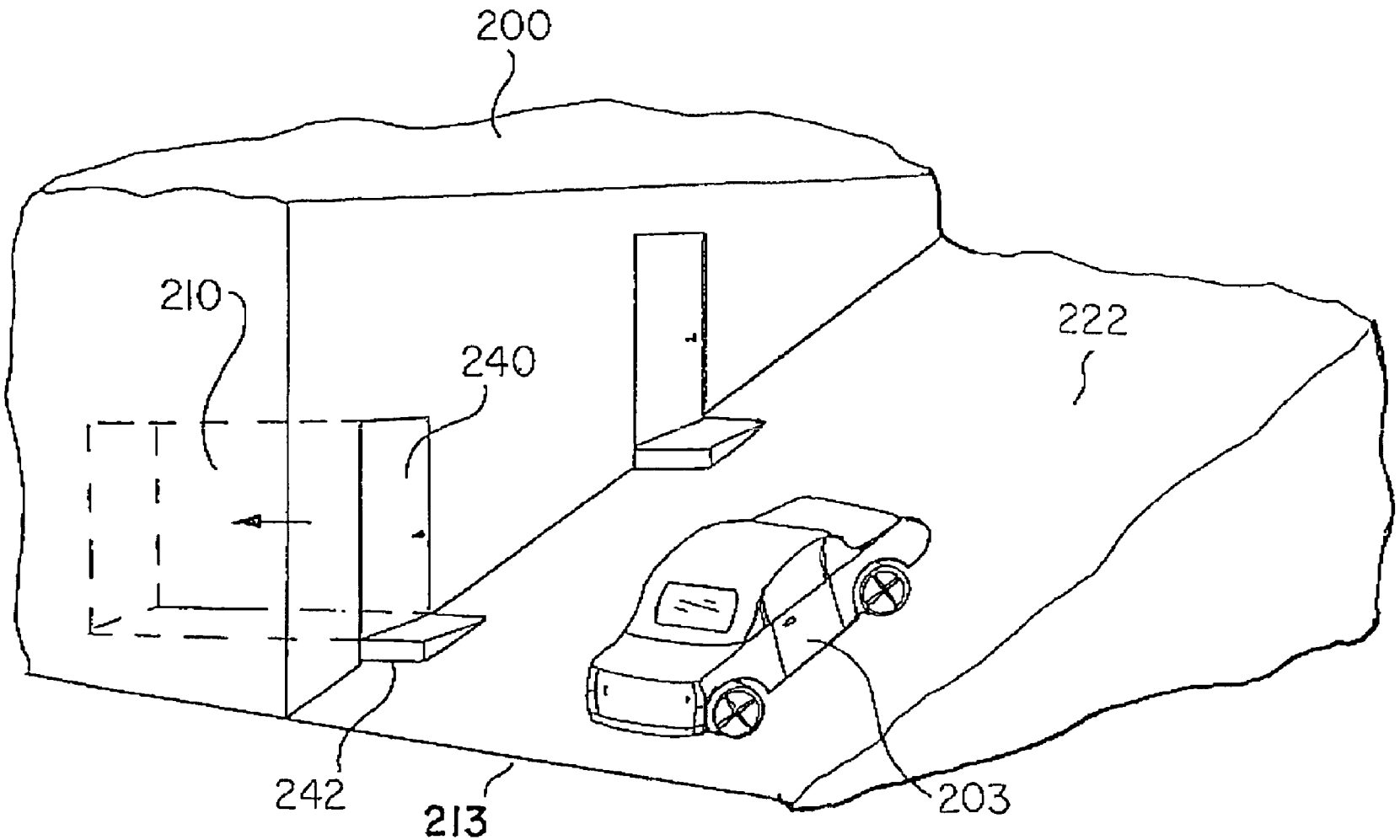
FIG. 5 is a detail of the upward ramp of a mixed-use pedestrian-oriented parking structure showing a back door entrance to the liner building.

FIG. 5 illustrates a back door entrance to the liner building.

Figure 6:
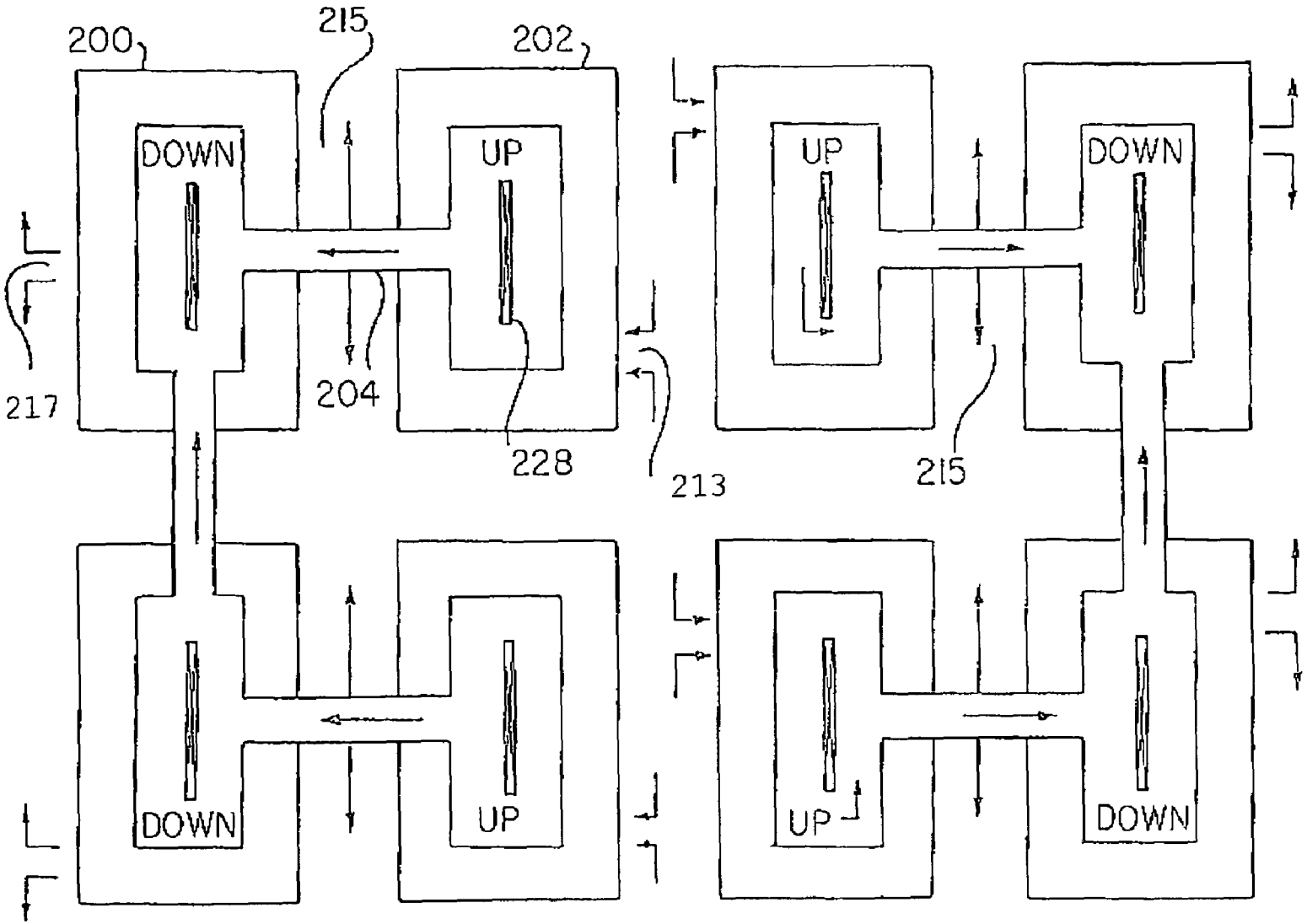
FIGS. 6 and 7 are conceptual views showing potential relationships between pairs of mixed-use, pedestrian-oriented parking structure of the type shown in FIGS. 1-3.

In FIG. 6 is shown an alternative layout which uses multiple groups of the structure of FIG. 2.

Figure 7:
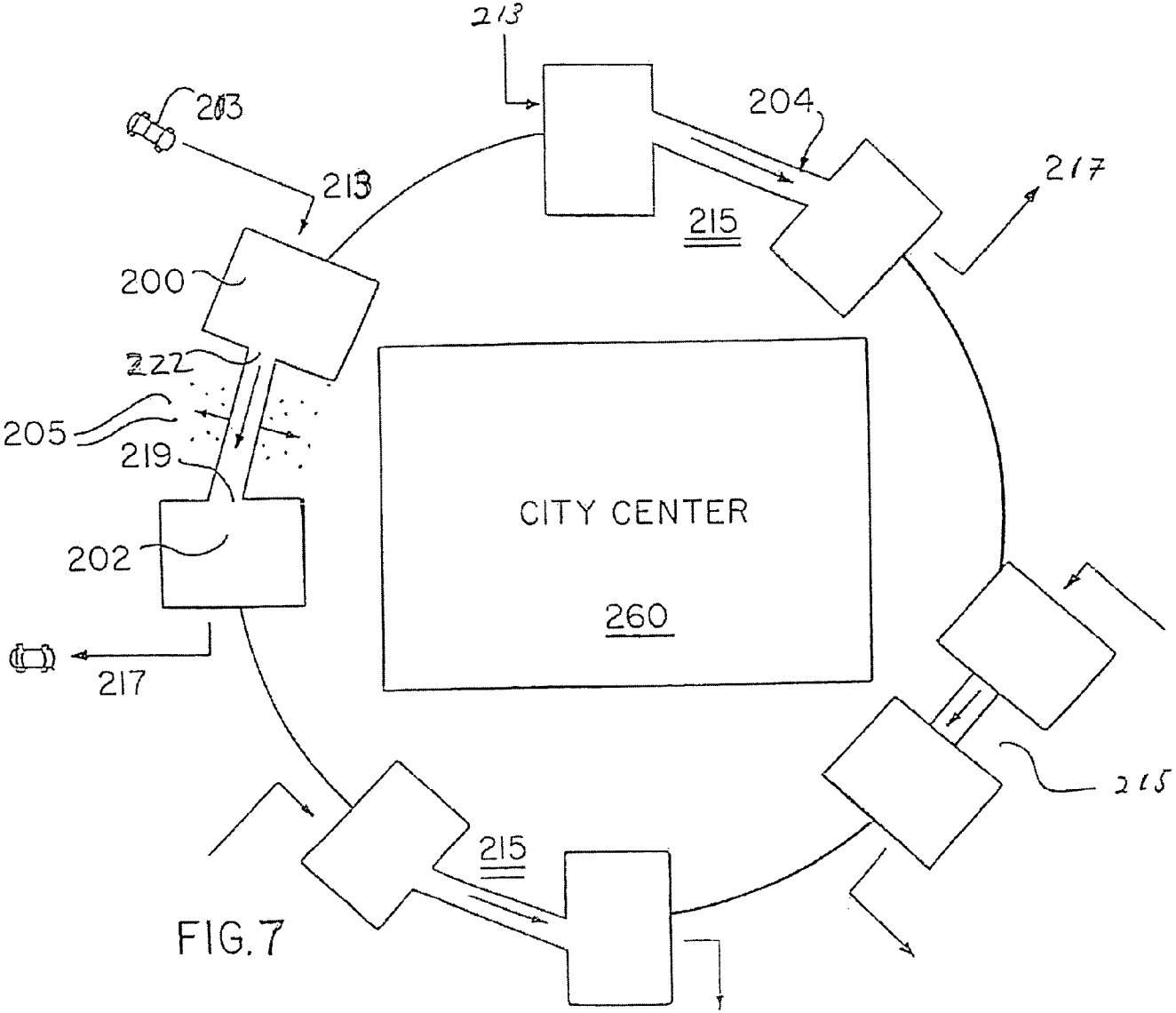

In FIG. 7 is shown the manner in which groups of parking garages 200 and 202 and liner buildings described above may be used in considerable numbers to surround specific common space 260 which includes publically significant structures such as a city hall, museums, arenas, stadiums, or other sports complex, cultural centers, and other large public facilities, parks, markets, churches, theatres, educational or health-care facilities, and libraries or to surround an entire town or entertainment district or the like.

It is to be appreciated that liner buildings 210 and 212 all possess sufficient depth and variable widths such that they may easily fit the needs and requirements of small retail, executive offices for start-up businesses and affordable housing. Funding sources from US DOT, HUD and SBA are but a few of the likely participants in several private/public venture possibilities. Back doors, balconies, outdoor staircases, and windows adjacent the parking garage structure 216, the atrium or air/light well 228 and liner building components provide useful, safe, interesting and comfortable views into and from the parking areas and back door platforms 242 and provide useful spacing of parked cars to allow for ease of access by residents. visitors, customers, and freight delivery services to liner building addresses. These design strategies contrast with automobile-oriented large garages to effectively create habitable space that is safe, comfortable, useful and interesting, and effectively constitute pedestrian-oriented three-dimensional alleys.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth herewith.

The invention claimed is:

1. A mixed-use pedestrian-oriented parking structure comprising:

an entry garage with a first side and an opposing second side, having a liner building surrounding said entry garage on at least one side thereof and back doors to access said liner building, said entry garage having multiple parking levels with one-directional parking access aisles, an upward unidirectional ramp, and a central atrium;

an exit garage with a first side facing said first side of said entry garage and an opposing second side, having a liner building surrounding said exit garage on at least one side thereof and back doors to access said liner building surrounding said exit garage, said exit garage having multiple parking levels with one-directional parking access aisles, a downward unidirectional ramp, and a central atrium;

a pedestrian ground space extending from said first side of said entry garage to said first side of said exit garage;

an auto cross-over ramp connecting said first sides of said entry and exit garages at a level above a ground level;

a mixed-use crossover connecting said first sides of said entry and exit garages at a level below said auto cross-over ramp and above said ground level, located underneath said auto cross-over ramp;

an entrance at said ground level through one side of said entry garage, away from said first side of said entry garage and said pedestrian ground space, said entrance leading to said upward unidirectional ramp in said entry garage; and an exit at said ground level through one side of said exit garage, away from said first side of said exit garage and said pedestrian ground space, said downward unidirectional ramp in said exit garage leading to said exit.

2. The parking structure of claim 1 further comprising a covered pedestrian crossing or mixed mode corridor at said ground level between said first sides of said entry and exit garages, underneath and aligned with said auto cross-over ramp.

3. The parking structure of claim 1, wherein said entrance of said parking structure is located on said second side of said entry garage.

4. The parking structure of claim 1, wherein said exit of said parking structure is located on said second side of said exit garage.

5. The parking structure of claim 1, wherein said entrance and said exit of said parking structure are in opposite sides of said parking structure.

6. The parking structure of claim 1 further comprising angled parking spaces on said multiple parking levels, situated about said central atrium in each of said garages.

7. The parking structure of claim 6 further comprising parallel parking spaces along an outer edge of said multiple parking levels in each of said garages.

8. The parking structure of claim 6, wherein said central atrium has a generally rectangular shape with a narrow width.

9. The parking structure of claim 6 further comprising trees and other foliages within said central atrium.

10. The parking structure of claim 6, wherein structural columns are positioned within said central atrium of said garages.

11. The parking structure of claim 1, wherein structural columns are positioned at perimeter of said garages to avoid shadowing within said garages and improve user safety.

12. The parking structure of claim 1, wherein each of said entry and exit garages includes a multi-use buffer corridor defining an interface between each of said garages at said multiple parking levels and respective liner building; and each of said liner buildings includes at least one common wall with said buffer corridor, said wall including said back doors to and from said liner building.

13. The parking structure of claim 12, wherein each of said liner buildings includes at least one corridor contiguous with said at least one common wall.

14. The parking structure of claim 12, wherein said buffer corridor includes HVAC facilities.

15. The parking structure of claim 1, wherein each of said liner buildings surrounds at least two sides of respective garage.

* * * * *